US011305962B2

(12) United States Patent
Ozasa et al.

(10) Patent No.: US 11,305,962 B2
(45) Date of Patent: Apr. 19, 2022

(54) ELASTIC YARN WOUND BODY PACKAGE

(71) Applicant: Toray Opelontex Co., Ltd., Osaka (JP)

(72) Inventors: Hiroki Ozasa, Shiga (JP); Hideki Nakanishi, Shiga (JP); Kayoko Nakajima, Shiga (JP); Koutarou Mizuno, Shiga (JP); Yutaka Sato, Shiga (JP)

(73) Assignee: TORAY OPELONTEX CO., LTD., Osaka (JP)

( * ) Notice: Subject to any disclaimer, the term of this patent is extended or adjusted under 35 U.S.C. 154(b) by 18 days.

(21) Appl. No.: 16/624,566

(22) PCT Filed: Jun. 29, 2018

(86) PCT No.: PCT/IB2018/054848
§ 371 (c)(1),
(2) Date: Dec. 19, 2019

(87) PCT Pub. No.: WO2019/003195
PCT Pub. Date: Jan. 3, 2019

(65) Prior Publication Data

US 2020/0216286 A1 Jul. 9, 2020

(30) Foreign Application Priority Data

Jun. 29, 2017 (JP) ..... JP2017-126894
Sep. 28, 2017 (JP) ..... JP2017-187677
May 28, 2018 (JP) ..... JP2018-101342

(51) Int. Cl.
*B65H 75/28* (2006.01)
*B65H 55/00* (2006.01)

(52) U.S. Cl.
CPC ..... *B65H 75/28* (2013.01); *B65H 55/00* (2013.01); *B65H 2701/319* (2013.01)

(58) Field of Classification Search
CPC ..... B65H 75/28; B65H 55/00; B65H 54/34; B65H 2701/319
See application file for complete search history.

(56) References Cited

U.S. PATENT DOCUMENTS 3,326,494 A 6/1967 Hartlet, Jr. ..... 242/125.1
4,063,696 A 12/1977 Kelly et al. ..... 242/125.1
(Continued)

FOREIGN PATENT DOCUMENTS

JP 7-25548 1/1995
JP 9-328260 12/1997
(Continued)

OTHER PUBLICATIONS

International Search Report and Written Opinion in PCT/IB2018/054848 dated Aug. 31, 2018.
(Continued)

*Primary Examiner* — William E Dondero
(74) *Attorney, Agent, or Firm* — Bridget C. Sciamanna; Kathleen A. Tyrrell

(57) ABSTRACT

Elastic yarn wound body packages able to simplify processing of a tail yarn of an elastic yarn when manufacturing a fabric, or the like, continuously by simultaneous vertical take-up unwinding of a multistage elastic yarn through providing elastic yarn wound body packages on a multistage stand are provided. The elastic yarn wound body package comprises a paper tube and an elastic yarn wound body, wherein: the paper tube has a groove in the circumferential direction, perpendicular to the paper tube axis, between an end portion of the elastic yarn wound body and an end portion of the paper tube; a tail yarn of the elastic yarn wound body is wound into the groove; and a wire-shaped object or tape-shaped object that crosses at least a portion of the yarn bundle of the tail yarn is held thereby. Also provided are paper tubes comprising, in the vicinity of at least one
(Continued)

end, a tail thread wrapping groove having parallel edges along a circumferential direction perpendicular to the axis of the paper tube, the paper tube comprising a recession, the maximum width of which is greater than the width of the tail thread wrapping groove and the deepest part of which is deeper than the tail thread wrapping groove, over the tail thread wrapping groove or an extension of the tail thread wrapping groove and elastic thread reel packages comprising these paper tubes.

4 Claims, 9 Drawing Sheets

(56) References Cited

U.S. PATENT DOCUMENTS

| | | | | |
|---|---|---|---|---|
| 4,518,133 | A | 5/1985 | Hill, Jr. | 242/165 |
| 2009/0114754 | A1 | 5/2009 | Hopstaken | 242/125.1 |

FOREIGN PATENT DOCUMENTS

| | | |
|---|---|---|
| JP | 2000-289931 | 10/2000 |
| JP | 2004-203519 | 7/2004 |
| JP | 2014-105103 | 6/2014 |

OTHER PUBLICATIONS

International Preliminary Report on Patentability in PCT/IB2018/054848 dated Dec. 31, 2019.

[FIG. 1B]

FIG. 2
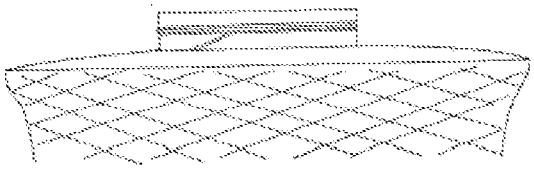
FIG. 2-1
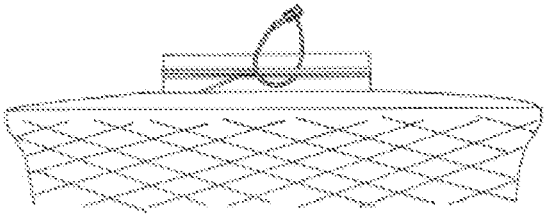
FIG. 2-2
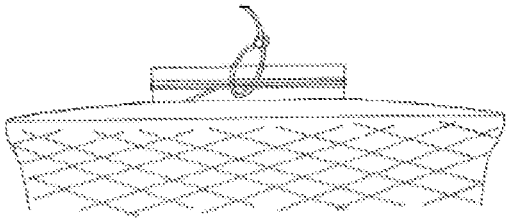
FIG. 2-3
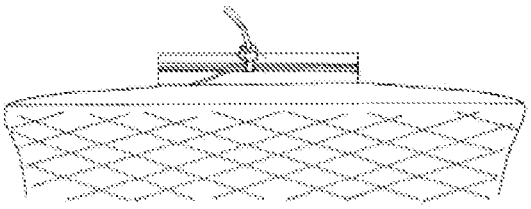
FIG. 2-4

FIG. 6
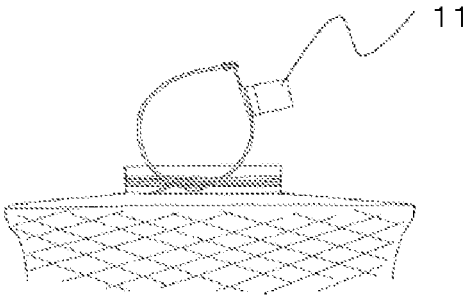
FIG. 6-1
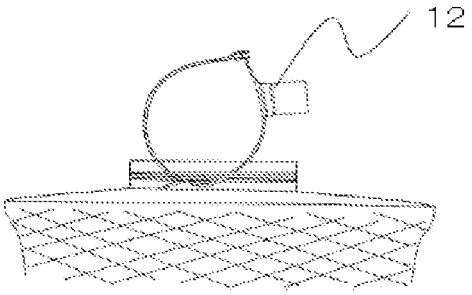
FIG. 6-2
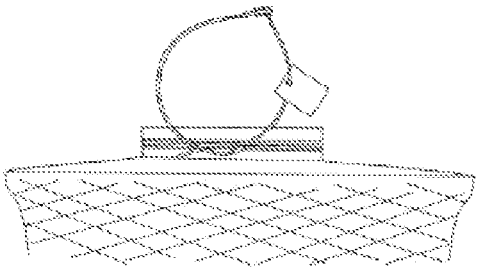
FIG. 6-3
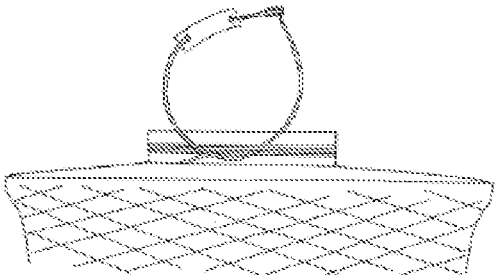
FIG. 6-4
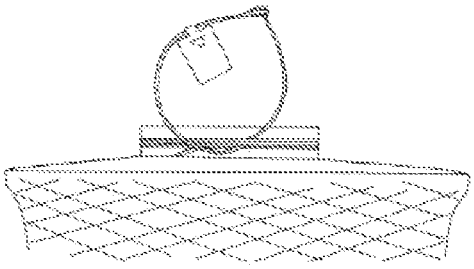
FIG. 6-5

FIG. 7
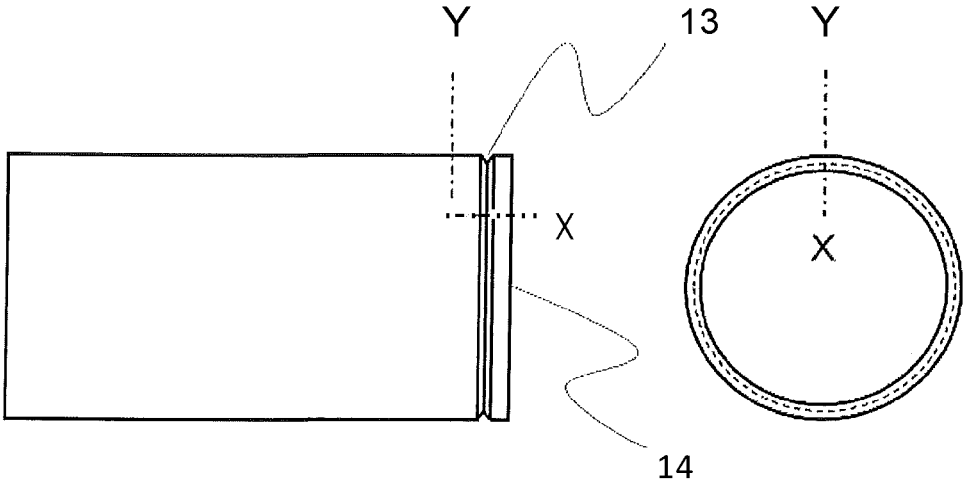
FIG. 7a-1 FIG. 7a-2
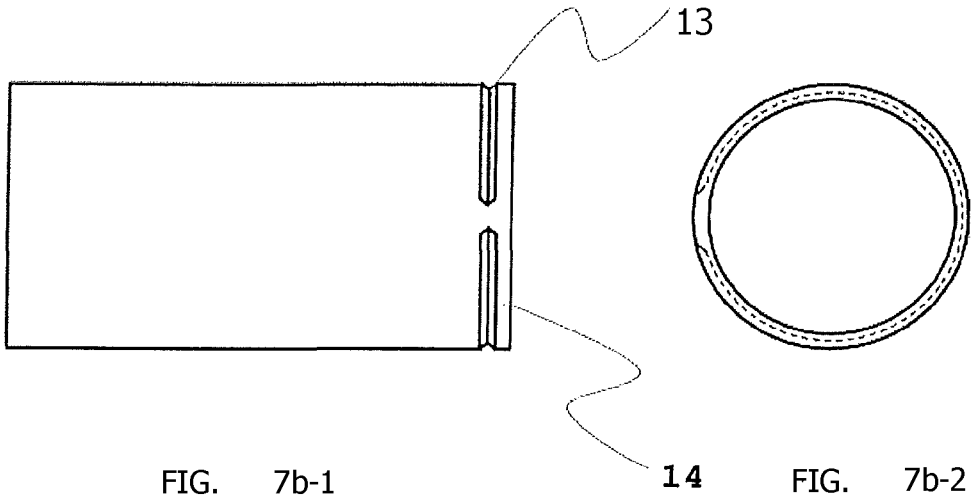
FIG. 7b-1 FIG. 7b-2

ELASTIC YARN WOUND BODY PACKAGE

FIELD OF TECHNOLOGY

The present invention relates to an elastic yarn wound body package that has a tail yarn and that is superior in terms of handling, and, specifically, relates to an elastic yarn wound body package wherein it is easy to retrieve the tail yarn of an elastic yarn in the manufacturing process of a processed product wherein elastic yarn is used as a material, thereby enabling an improvement in ease of operations when switching the wound body. More specifically, it relates to an elastic yarn wound body package wherein there is a particularly significant effect when used with a processing apparatus that takes up and releases elastic yarn in the winding core direction, for elastic yarns that are medium/large gauge products. The present invention also relates to a paper tube that yields an elastic thread reel package of superior ease of handling, and to an elastic thread reel package using said paper tube.

PRIOR ART

Elastic yarns, and in particular polyurethane elastic yarns (which may also be termed "polyurethane elastic fibers"), are used as functional raw materials that stretch and retract, in garments such as foundations, socks, pantyhose, swimwear, and the like, and in the field of sports, taking advantage of the stretchable characteristics thereof. Moreover, in recent years these have been combined with non-woven fabrics and used as stretchable members for three-dimensional gather portions, waist portions, and leg portions in disposable diapers, and sold throughout the world in a variety of sizes and designs for adults, for nursing care, for children, for infants, and the like. They have also been used in sanitary napkins, and the like.

In order to facilitate this large variety of sizes and designs, there are known technologies wherein the gauge and yarn stretchability of the elastic yarn is varied depending on the location, and wherein several elastic yarns or several dozen elastic yarns are provided simultaneously, running in parallel, attached to the non-woven fabric.

In Patent Document 1, given the need to be able to use a large number of polyurethane elastic yarns continuously in disposable diapers or sanitary materials, described above, in recent years, vertical take-up unwinding, wherein the polyurethane elastic yarn is released in the axial direction of a paper tube has been becoming the dominant approach. In elastic yarn wound body packages that use such a vertical take-up unwinding, there is a description of forming lead yarns (also known as "yarn ends") and tail yarns (also known as "tales"), with the provision of a groove (also termed a "slit"), in the circumferential direction, further to the outside than the winding width of the elastic yarn wound body on a paper tube that uses a tail yarn at this time, and placing, into the groove, the yarn at the start of winding. The use of such a structure enables the tail yarn to be connected to the lead yarn from another elastic yarn wound body package, enabling the elastic yarn wound body to be switched without stopping processing, enabling continuous vertical take-up unwinding.

Patent document 2 discloses matters pertaining to a groove in a paper tube for forming a tail thread, and patent document 3 discloses matters pertaining to groove shape in a paper tube for elastic thread.

In recent years, in sanitary products such as disposable diapers, and the like, that use a combination of non-woven fabrics and elastic yarns, the increase in consumer population has led to an increase in production volumes, and the amount of elastic yarns used has also increased commensurately, and thus in the manufacturing process for such products there is a need to increase the ease with which the tail yarn can be retrieved from the elastic yarn wound body package.

At present, the dominant method is generally that the tail yarn is put into a shape that is reconciled through cutting to a length that is adequate for what is needed to remove the tail yarn from the groove in the paper tube after manufacturing of the elastic yarn wound body package and for connecting to a lead yarn, or a method wherein, even after the elastic yarn has been wound up, the tail yarn is wound into the paper tube groove, so that, at the time of processing, it is removed therefrom by a human or by a machine.

In a form wherein the tail yarn is retrieved after manufacturing of the elastic yarn wound body package described above, when shipping to the processing plant for the product for a sanitary material application, such as a disposable diaper, or the like, the tail yarn becomes damaged, through abrasion, or the like, through contact with the wrapping material, and through vibration during transport, giving rise to a problem with the yarn breaking during vertical take-up unwinding in the processing plant, and thus an elastic wound body package in a form wherein the tail yarn is wound into the paper tube groove is desirable. While this would make it possible to avoid damage that is received during transport when shipping to the processing plant, this would necessitate an operation for retrieving the tail yarn from the elastic yarn wound body package at the processing plant, that is, an operation wherein a person would have to find the location for retrieving the tail yarn bundle from the paper tube groove, and then have to grasp the tail yarn bundle by hand and adjust to the length of tail yarn required for connecting to the lead yarn, and so forth, requiring operations that are laborious and time-consuming. In particular, when retrieving the tail yarn by hand from the paper tube groove, the elastic yarn, which is stretchable, bites into the paper tube groove, making it difficult and time-consuming to retrieve. Consequently, the problem is to improve visual recognizability of the location for retrieving the tail yarn, and to facilitate ease of grasping the tail yarn, in the processing plant.

While innovations are disclosed, such as in Patent Document 4, so as to improve retrieval of the tail yarn through the provision of a location wherein the groove cut portion is partially absent, from the provision of a paper tube groove around the entire periphery of the paper tube, where the position of the tail yarn of the elastic yarn that is wound there again is checked visually by the processing operator, and the tail yarn is retrieved through being grasped by hand, still this requires the entire periphery of the paper tube of the elastic yarn wound body package to be checked, to find that part, and problems remain with visual recognizability.

JP-A 2000-289931
JP-A 2004-203519
JP-A H09-328260
JP-A 2014-105103

SUMMARY OF THE INVENTION

The problem to be solved by the present invention is that of providing an elastic yarn wound body package and paper tube for the packageable to further reduce the operational overhead resulting from enabling retrieval of a tail yarn of a length necessary for connecting reliably to a lead yarn, whether by hand or through the use of a tool, through the ability to more easily recognize visually the position at which the tail yarn is attached, even with a paper tube wherein there is no partial groove cut portion as in Patent Document 4.

In order to solve the problem set forth above, the present invention employs any of the following means:

(1) A paper tube comprising, in the vicinity of at least one end, a tail thread wrapping groove having parallel edges along a circumferential direction perpendicular to the axis of the paper tube, the paper tube comprising a recession, the maximum width of which is greater than the width of the tail thread wrapping groove and the deepest part of which is deeper than the tail thread wrapping groove, over the tail thread wrapping groove or an extension of the tail thread wrapping groove.

(2) The paper tube according to (1), wherein the recession has a groove shape such that at least one side is greater than the width of the tail thread wrapping groove, and intersects the circumferential direction perpendicular to the axis of the paper tube.

(3) The paper tube according to (2), wherein the groove-shaped recession intersecting the circumferential direction orthogonal to the axis of the paper tube reaches an end of the paper tube.

(4) The paper tube according to any of (1)-(3), wherein at least part of the recession penetrates the paper tube.

(5) An elastic yarn wound body package comprising a paper tube and an elastic yarn wound body, wherein: the paper tube has a groove in the circumferential direction, perpendicular to the paper tube axis, between an end portion of the elastic yarn wound body and an end portion of the paper tube; a tail yarn of the elastic yarn wound body is wound into the groove; and a wire-shaped object or tape-shaped object that crosses at least a portion of the yarn bundle of the tail yarn is held thereby.

(6) An elastic yarn wound body package as set forth in (5), above, wherein: the wire-shaped object or tape-shaped object is ring-shaped; and the yarn bundle of the tail yarn is a loose bundle.

(7) An elastic yarn wound body package as set forth in (6), above, wherein: a loop length of the wire-shaped object or tape-shaped object that has formed a ring shape is longer than a circumference of the paper tube, and is set in a state wherein the paper tube is disposed within the loop.

(8) An elastic yarn wound body package as set forth in any one of (5) through (7), above, wherein: the material of the wire-shaped object or tape-shaped object is flexible.

(9) An elastic yarn wound body package as set forth in any of (5) through (8), above, wherein: at least one tag is attached by the wire-shaped object or tape-shaped object.

In the present invention, a tail yarn is provided on a winding core paper tube, where the position for retrieving the tail yarn is easily visually recognizable, and the tail yarn can be retrieved reliably by hand or through use of a tool such as a jig and the work burden can be further reduced. Even during case crating and transport, disruption of the tail yarn portion can be prevented.

BRIEF EXPLANATIONS OF THE DRAWINGS

FIG. 1B is a schematic diagram depicting the state wherein the tail yarn is pulled out by a tape-shaped object that is held by the tail yarn of an elastic yarn wound body package according to the present invention.

FIGS. 2-1 thru 2-4 are schematic diagrams depicting elastic yarn wound body packages used by Embodiments 1 and 2 and Reference Examples 1 and 2.

Figure 3:
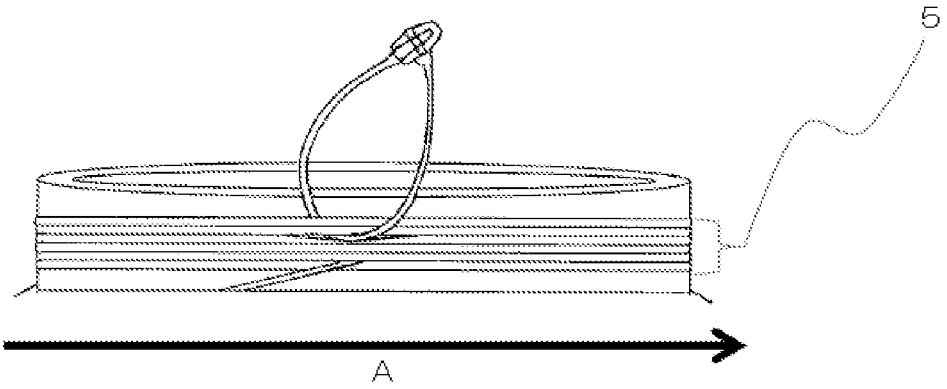

FIG. 3 is an enlarged view of the tail yarn part of FIG. 2-2.

Figure 4:
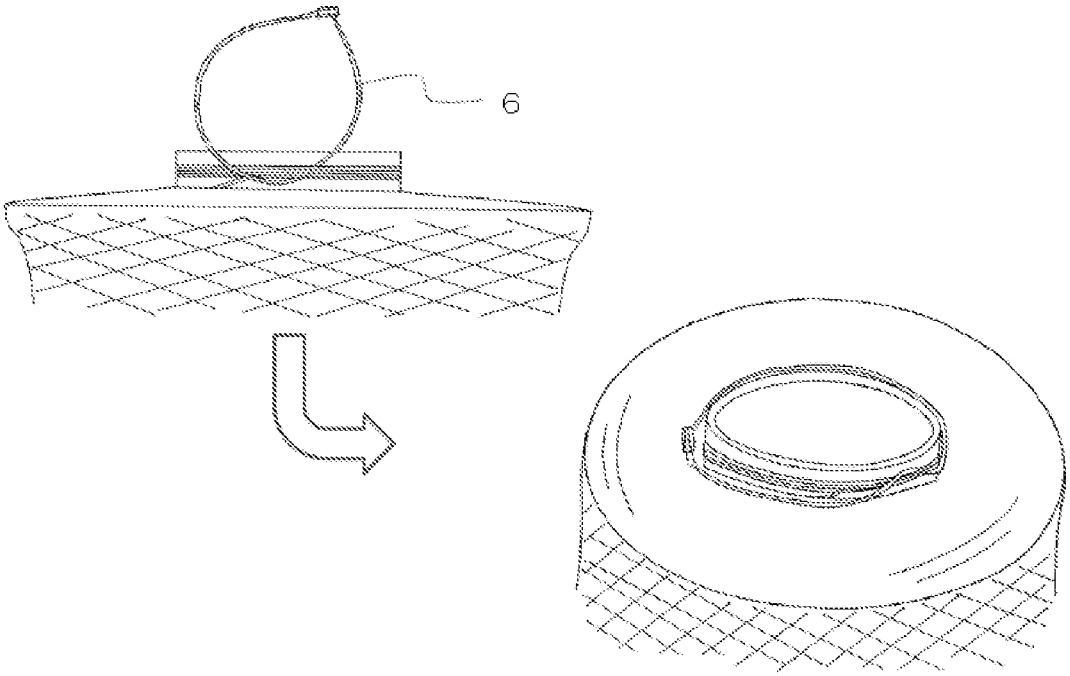

FIG. 4 is a schematic diagram depicting an elastic yarn wound body package used in a third embodiment.

Figure 5:
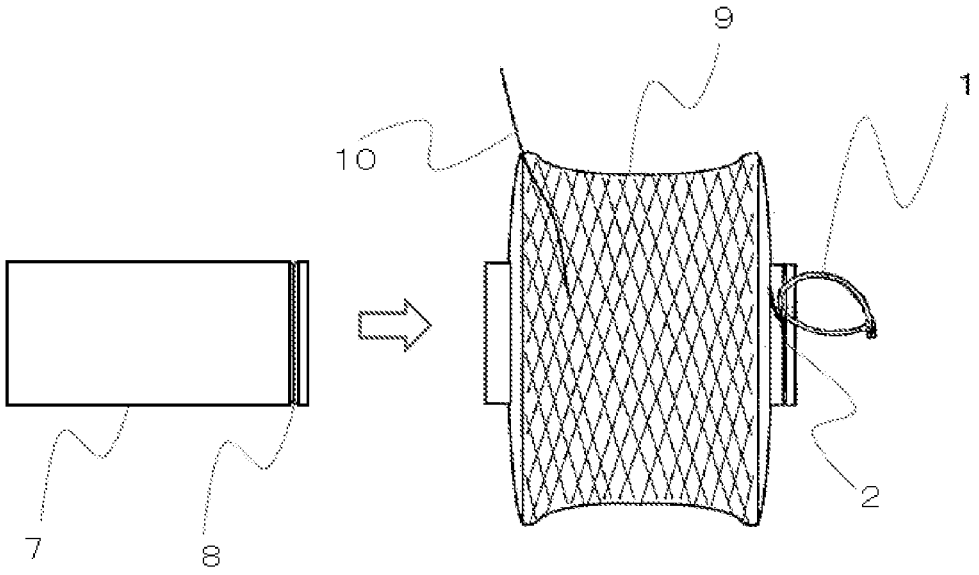

FIG. 5 is a schematic diagram depicting a paper tube and the entirety of an elastic yarn wound body package according to the present invention.

Figure 1A:
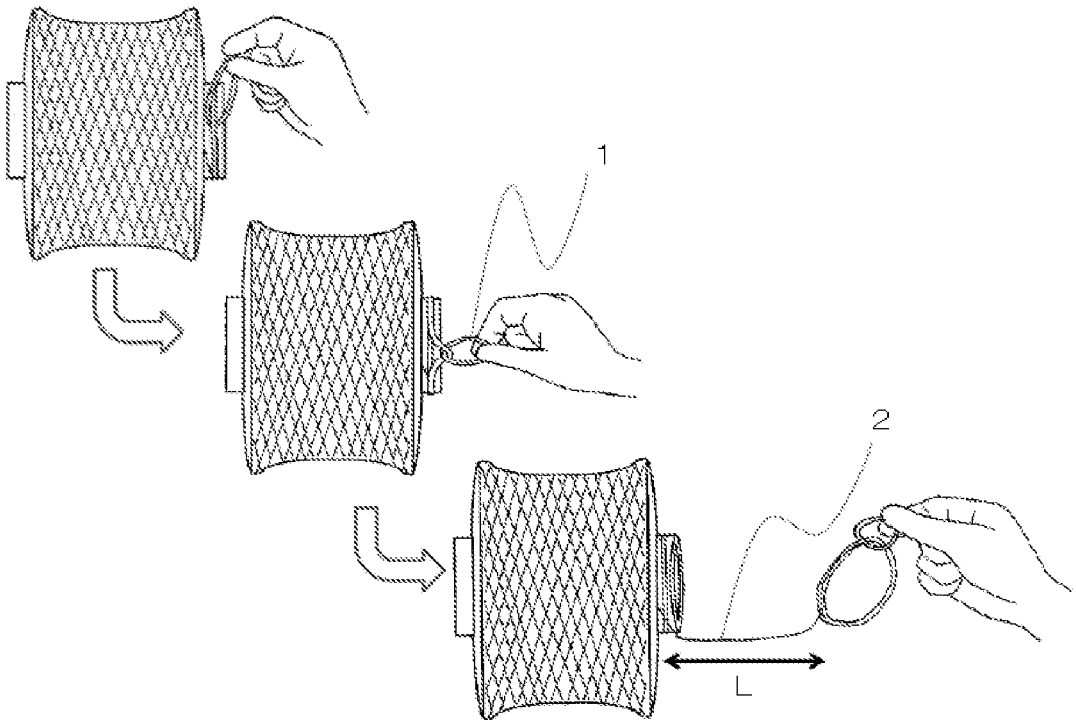
FIG. 1A is a schematic diagram depicting a state wherein the tail yarn has been pulled out by a wire-shaped object that is held by the tail yarn of an elastic yarn wound body package according the present invention.
Figure 1A:
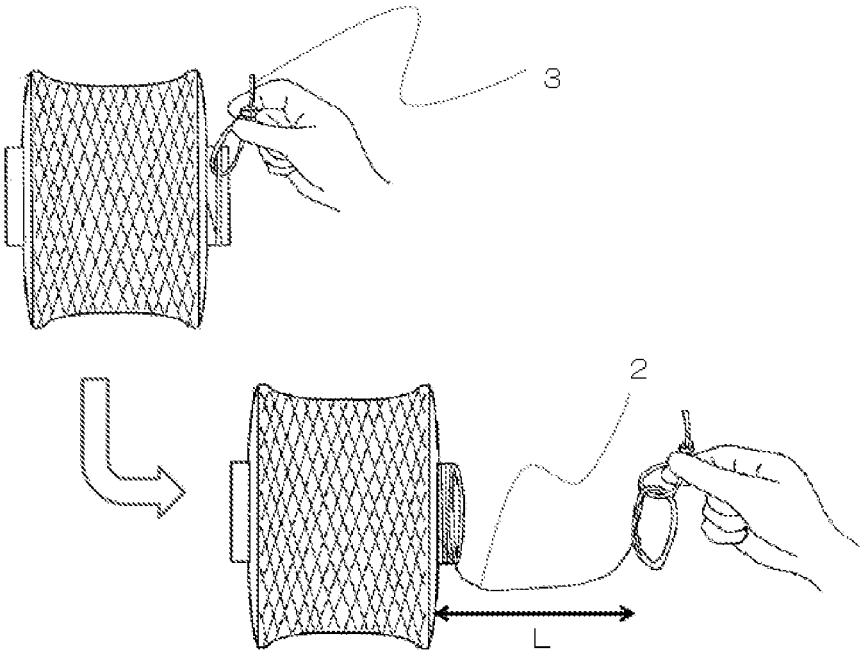

FIGS. 6-1 thru 6-5 are schematic diagram depicting an example of an elastic yarn wound body package wherein a tag is attached to a wire-shaped object.

FIGS. 7*a*-1, *a*-2, *b*-1 and *b*-2 provide a schematic illustration of conventional paper tubes.

Figure 8:
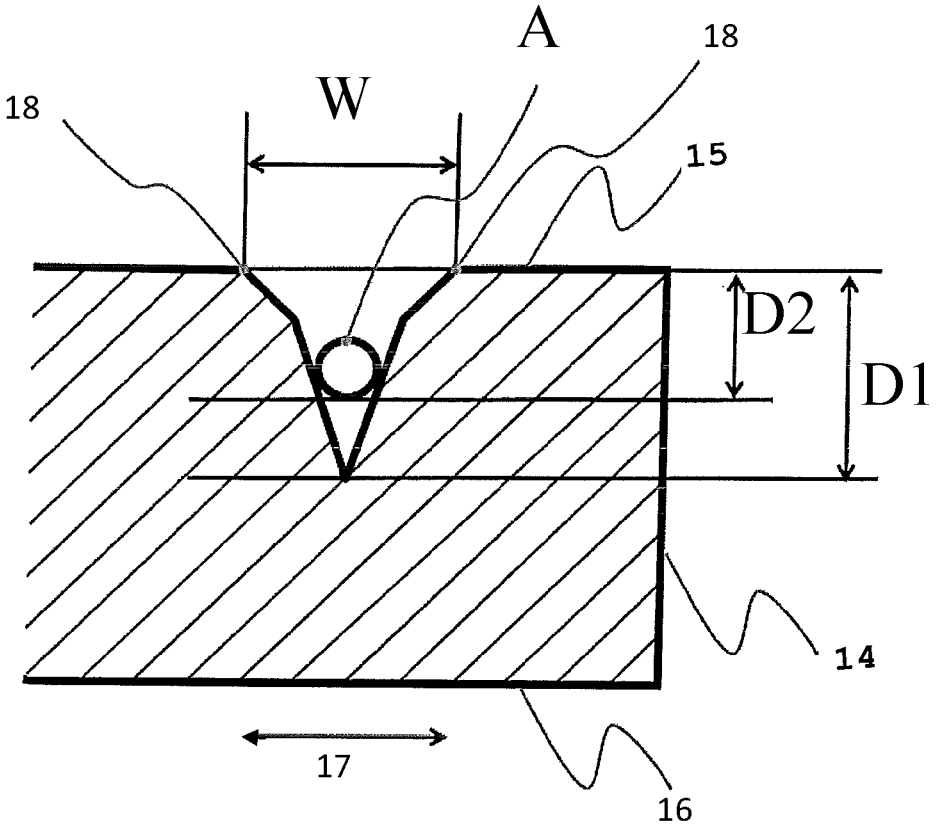

FIG. 8 is a schematic illustration of an example of the cross section of a tail thread wrapping groove of the present invention.

Figure 9:
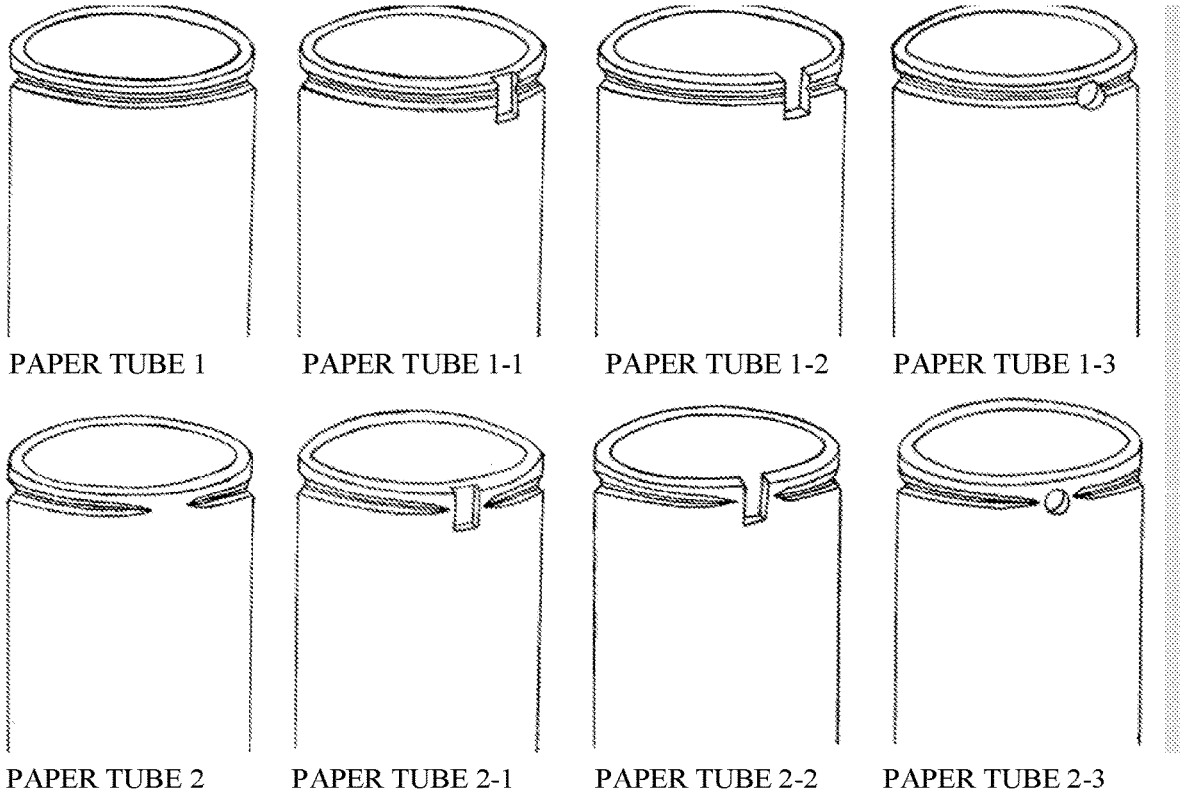

FIG. 9 is a schematic illustration of paper tubes used in examples and comparative examples.

FORMS FOR CARRYING OUT THE PRESENT INVENTION

The present invention is an elastic yarn wound body package made from a paper tube and an elastic yarn wound body and a paper tube for use in elastic reel thread packages. The paper tube has a groove, in the circumferential direction that is perpendicular to the paper tube axis, between an end portion of the elastic yarn wound body and an end portion of the paper tube, where the tail yarn of the elastic yarn wound body is wound into the groove, and a wire-shaped object or a tape-shaped object that crosses at least a portion of the yarn bundle of the tail yarn is held thereby.

In the present invention, the elastic yarn wound body refers to the elastic yarn being wound up in the form of a cheese, where that wherein an elastic yarn wound body is wound onto a paper tube is termed an "elastic yarn wound body package." In the present invention, the paper tube has a groove, in the circumferential direction that is perpendicular to the paper tube axis, between an end portion of the elastic yarn wound body and an end portion of the paper tube, and the tail yarn of the elastic yarn wound body is wound into the groove. That is, as illustrated in FIG. 5, in the elastic yarn wound body package according to the present invention, there is a groove 8 for winding on the tail yarn 2 in at least one part wherein the paper tube 7 is exposed from the elastic yarn wound body 9, and the elastic yarn that serves as the tail yarn 2 is wound therein. Given this, a wire-shaped object or tape-shaped object that crosses at least a portion of the yarn bundle of the tail yarn is held thereby. Through the use of such a structure, the tail yarn 2 can be pulled out easily from the elastic yarn wound body package through grasping and pulling the wire-shaped object or tape-shaped object wherein it is held, when used by a processing apparatus. Through this, the tail yarn 2 can be joined to the lead yarn 10 of the elastic yarn wound body package that is to be used next, enabling switching of the elastic yarn wound body smoothly, without interrupting processing. Note that the definitions of "wire-shaped object" and "tape-shaped object" are given below.

While there is no particular limitation for the shape of the paper tube according to the present invention, typically it is a round cylindrical tube such as shown in FIG. 7 (wherein 7*a*-1 and 7*b*-1 are views of the elastic thread wrapping surface, and 7*a*-2 and 7*b*-2 are views along the axial direction of the paper tube) is typical. A colored paper is adhered to the surface of the paper tube, and a cellophane film that has regenerated cellulose as its main component, or a moisture-proof cellophane film, polyester film, or the like, is further laminated over the colored paper, or a resin coating agent that has polyvinyl alcohol as the main component, or an equivalent thereof, is coated over the colored paper for use. Moreover, although colored paper itself is adhered, and used after being subjected to a texturing process, an embossing process, or the like, in the present invention the effects of the invention are not lost due to differences in the materials of the paper tube, the surface agents, or the surface processing methods.

The presence of a tail yarn winding groove, between the end portion of the elastic yarn wound body and the end portion of the paper tube, on at least the side that is further toward the end, in the axial direction of the paper tube, than the winding width on which the elastic yarn is wound, that is, in a part that is an exposed portion of the paper tube in the elastic yarn wound body package, enables a part that extends out, when forming the elastic yarn wound body, to be pulled out as a tail yarn.

Generally having the exposed portions of the paper tube in the elastic yarn wound body package be between 5 and 10% at both ends, when the length of the paper tube is defined as 100%, is preferred. Typically, the exposed paper tube portion in an elastic yarn wound body package with an elastic yarn net weight of 4.5 kg is between 8 and 15 mm each. A groove for securing the tail yarn is provided on at least one of these. Note that when the tail yarn winding groove is in the vicinity of only one of the end portions, making a package wherein the elastic yarn wound body is positioned so that the length of the exposed portion of the paper tube on the side with the groove is longer than on the other side would not be a problem.

The tail yarn winding groove refers to a groove that is provided in the direction in which the tail yarn is wound on, that is, the direction that is perpendicular to the axis of the paper tube. Moreover, the groove, while in the circumferential direction that is nonstop to the axis of the paper tube, may exist around the entire periphery, or there may be a part wherein the groove is discontinued in a portion in the circumferential direction. When the tail yarn winding groove is not around the entire circumference, the proportion of the length wherein the tail yarn winding groove is not present is preferably between 3 and 10%, when the circumference of the paper tube is defined as 100%, and more preferably between about 4 and 8%, from the perspective of reliably holding the tail yarn in the tail yarn winding groove during winding.

The method for forming the tail yarn winding groove in the paper tube has no particular limitation, such as a method for forming a continuous depression through pressing, a method of introducing a cut using a blade, or the like, but a method wherein a cut is formed through application of a rotating blade is preferred. Reasons for this include the ability to change the shape of the groove depending on the shape of the rotating blade, the ability to change freely the depth and width of the groove through how the rotating blade is applied, the ability to form a groove with a complex cross-sectional shape through the use of combinations of rotating blades having different shapes, and the like. Moreover, given that the groove is applied through such a process, the cross-sectional shape of the tail yarn winding groove is typically a V-shape or an essentially V-shape, or a shape similar thereto.

The shape of the tail winding groove within the surface of the paper tube (the change in the groove width), and the cross-sectional shape of the tail winding groove, should be set in consideration of the shape of the tail yarn, that is, the effective surface when winding, the decitex (dtex) of the elastic yarn, the modulus of elasticity thereof, and the like. For example, in order to facilitate easy winding of the tail yarn onto the paper tube, a shape may be provided wherein the groove width of a portion of the tail winding groove may be wider than at another part, and may be cut more deeply, as a lead-in groove. Moreover, in general, preferably the depth of this lead-in groove is less deep than the rest of the tail yarn winding groove. Such a lead-in groove may exist in a plurality of locations in the groove facing the peripheral direction.

When forming the elastic yarn wound body package through winding elastic yarn onto the paper tube, first the elastic yarn is wound into the tail yarn winding groove that is provided on the paper tube, after which the elastic yarn wound body part is formed, to produce the elastic yarn wound body package. The tail yarn is wound biting into the groove on the paper tube, and forms a yarn bundle within the groove.

There is no particular limitation on the length of the tail yarn of the elastic yarn wound body package, which may be set as appropriate depending on the winder mechanism for winding up the elastic yarn, but normally winding at least two winds into the tail yarn winding groove of the paper tube is preferred, and winding at least five winds is even more preferred. While there is no particular limitation on the upper limit of the number of winds into the tail yarn winding groove of the paper tube, usually it is adequate if 10 winds are wound, and preferably the winding is to a degree that the tail yarn does not extend beyond the groove.

In the present invention, a wire-shaped object (1 in FIG. 1A) or a tape-shaped object (3 in FIG. 1B) that crosses at least a portion of the yarn bundle of the tail yarn is held by the yarn bundle (5 in FIG. 3) of the tail yarn that is wound into the tail yarn winding groove of the paper tube. "At least a portion" indicates between about 20 and 100%, and preferably between about 50 and 90%, relative to the total number of winds with which the tail yarn is wound on. "Crosses" means that the wire-shaped object or tape-shaped object should cross the direction of the tail yarn groove, that is, the direction in which the tail yarn is wound (A in FIG. 3).

For the "wire-shaped object" and the "tape-shaped object," if, for the cross section of the part that crosses the tail yarn, the circumscribing rectangle of the minimum area were drawn, that wherein the short edge/long edge ratio is between 0.7 and 1 would be a "wire-shaped object," and that wherein the short edge/long edge ratio is no less than 0.01 and less than 0.7 would be a "tape-shaped object."

The material for the wire-shaped object or tape-shaped object may be of a raw material such as paper string, cotton thread, or the like, of a plastic resin such as nylon, polyester, or the like, of a combination thereof, or may be reinforced with wire, or the like, as typical examples, but there is no limitation thereto. Because there will be stretching when winding onto the tail yarn of the elastic yarn wound body, and because it is necessary to cross the tail yarn that is wound and held, such as with rubber, that which is made out of nylon or a polyester resin is preferred, in consideration of the balance of some degree of rigidity and flexibility.

That which is particularly preferred is that wherein a nylon resin or polyester resin is molded into what is fundamentally a wire or tape shape, where, if a wire, preferably the cross section is a round shape with a diameter between about 0.2 and 1.0 mm, and if a tape shape, preferably the tape thickness is no greater than 1.0 mm, and the tape width is between about 2.0 and 4.0 mm.

Preferably the wire-shaped object or tape-shaped object according to the present invention is applied crossing the tail yarn, where the wire-shaped object or tape-shaped object is in a ring shape, and causes the yarn bundle of the tail yarn to become a loose bundle. "Ring-shaped" refers to forming a looped shape as a whole, or a partial loop shape. "Loose bundle" indicates a state wherein, due to the wire-shaped object or the tape-shaped object, the yarn bundle is not in a tight state (4 in FIG. 1 C, FIG. 2-4), that is, wherein the tail yarn can move freely within the ring (loop) formed by the wire-shaped object or tape-shaped object. This is, if a normal tight bundle, that is, if tightened completely so that the bundle of the tail yarn will not be disrupted, it would not be possible to change the length of the tail yarn (L in FIGS. 1A and 1B) when pulling out the tail yarn from the elastic yarn wound body package using the wire-shaped object or tape-shaped object according to the present invention.

As representative examples of specific wire-shaped objects there are resin molded products such as, for example, those made from nylon or polyester known as, for example "Loop Lock" (registered trademark) thread locks, "Chain Locks" (registered trademark), loose ties, tag fasteners, and the like, where that which is commercially available wherein the tip end on one end is narrow, and teeth, for the purpose of preventing removal, are provided (are present) on that tip end, where the other tip end has an insertion opener for securing, to thus have a function for preventing removal, may be used, and the thickness, the loop length, and the like, can be changed as appropriate. These can be formed easily into loop-shaped rings (loops), where that which is processed so as to secure both ends of the wire-shaped object is well-suited because the tail yarn can be loosely bundled easily. Moreover, that wherein the tip end is pointed is preferred, in order to cross a portion of the yarn bundle of the yarn on the paper tube.

Moreover, while it may be formed from, for example, a monofilament line made of nylon, such as is used in fishing, or the like, or a handicraft yarn that plies together natural fibers such as cotton or hemp with synthetic fibers, or a sewing machine thread, when forming the loop it is necessary to join both ends together, and thus the use of a resin molded product, wherein both ends can be secured together, as described above, is preferred.

Typical examples of specific tape-shaped objects include resin molded products that are typically made of nylon or polyester, known as, for example, bundling bands, cable ties, "Insulock" (registered trademark), or the like, and commercially available products may be used, and that wherein the line shape, loop length, and the like, can be changed as appropriate may be used. For these, that wherein the loop-shaped ring (loop) can be formed easily, and where the size of the loop can be changed freely, are well-suited. Moreover, given crossing a portion of the yarn bundle of the tail yarn on the paper tube, those wherein the tape width is narrow, and where one of the tip ends is pointed, are preferred.

As described above, the provision of the wire-shaped object or tape-shaped object crossing at least a portion of the yarn bundle of the tail yarn enables them to serve as guide marks, as the position for retrieving the tail yarn, greatly improving visual recognizability. Moreover, forming these into loops enables easy grasping when retrieving by hand, and, in some cases, enables snagging using an L-shaped hooked tool. This enables the operation for retrieving the tail yarn (the tail yarn retrieving operation) to be automated, using an apparatus or a machine.

Moreover, having the length of the loop of the wire-shaped object or tape-shaped object be greater than the circumference of the paper tube makes it possible to set in a state wherein the paper tube is positioned within the loop (FIG. 4). This makes it possible to avoid incidents wherein the tail yarn comes off by accident, through being contacted by the crating material, when crating the elastic yarn wound body package with a case and shipping to the processing plant. In this case, preferably the loop length is between 1.1 and 1.5 times the paper tube circumference. If less than 1.1 times, there would be a reduction in the ease of operations when positioning the paper tube inside of the loop, and if greater than 1.5 times, there would be a tendency for the paper tube to come out of the loop.

Moreover, the wire-shaped object or tape-shaped object having flexibility means that, specifically, the shape of the loop can be deformed to an arbitrary shape depending on the size and shape of a suction input of a machine such as an air ejector or a suction device. The flexibility of the wire-shaped object or tape-shaped object enables suction of the tail yarn bundle, enabling easy retrieval from the elastic yarn wound body package.

Moreover, in the elastic yarn wound body package according to the present invention, preferably at least one tag is attached by the wire-shaped object or tape-shaped object. Here the "tag" is a tag that is attached for adding information pertaining to that to which the tag is attached.

There is no particular limitation on the size or shape of the tag, but if too large there would be a relatively large possibility of damage, such as breaking or deforming, such as wrinkling or bending, and if too small, there could be problems such as with visual recognizability, or the inability to thoroughly cover the amount of information. From these points of view, preferably the size and shape of the display surface should be in a range that is kept to a square of between 10 and 80 mm. Moreover, if there were corners in the shape, this could damage the elastic yarn at the surface of the elastic yarn wound body package, and thus preferably, for a polygon shape, the shape is such that the connecting portions for the individual edges are rounded, rather than having corners.

While there is no particular limitation on the thickness of the tag, if too thin there would be a relatively large possibility of damage through deformation or tearing, and if too thick, this would be a direction that is relatively resistant to deformation, which would improve visual recognizability, but could cause damage to the elastic yarn wound body package. From this perspective, preferably it is in a range of between 0.05 and 0.5 mm.

For the material for the tag there is no particular limitation, but it should be selected as appropriate from the point of view of deformability and of printing for displaying information. From the point of view of deformability, if too soft there would be a reduction in visual recognizability and in the ability to read the information, due to deformation, but if too hard, it could damage the elastic yarn wound body package. From the point of view of printability, preferably it is paper or a resin film that has been coated, or the like, for printing, or something wherein these are layered together.

For the method for attaching the tag, there is no particular limitation, as long as the tag does not accidentally become detached from the wire-shaped object or the tape-shaped object, and a method may be used such as: (i) integration with the wire-shaped object or tape-shaped object; (ii) affixing to the wire-shaped object or tape-shaped object; (iii) attaching a tag movably through passing the wire-shaped object or tape-shaped object through a hole or cylindrical position formed in the tag; or the like. An example of a tag 11 that is attached to a wire-shaped object, and of an elastic yarn wound body package to which the tag 11 is attached, through the method in (iii), above, is illustrated in FIG. 6. FIG. 6-1 is an example of attaching a tag through folding back and adhering a portion of the tag to form a cylindrical position, and passing the wire-shaped object through the tag. An adhesive agent may be used in securing the position that is folded back, and thermal fusion, a stapler, or the like, may be used instead, with no particular limitation. Moreover, the wire-shaped object may be attached to the cylindrical position so as to enable movement, or the tag may be attached so as to enable movement without securing the wire-shaped object and the tag. FIG. 6-2 is an example wherein perforations 12 for tearing are provided in the tag of FIG. 6-1, and the tag is torn off when the elastic yarn wound body package is used. FIG. 6-3 is an example wherein the wire-shaped object passes through one hole that is provided in the tag. FIG. 6-4 is an example wherein the wire-shaped object passes through two holes that are provided in the tag. The tag may be secured loosely to the wire-shaped object through changing the size of the hole that is provided. FIG. 6-5 is an example wherein a portion of the tag is folded back to form a tubular part, and the wire-shaped object is passed therethrough.

The attachment of the tag enables the elastic yarn wound body package to be identified easily. For example, in a processing plant that uses different types of elastic yarn wound body packages simultaneously for adhering to non-woven fabrics, identification of the elastic yarn wound body package is important in order to produce the prescribed product, and being able to identify the elastic yarn wound body package easily in such a state is useful from the perspective of operational efficiency and product yield.

Attaching information for identifying the elastic yarn wound body package through the tag color or shape and/or text, numbers, symbols, or the like, that are displayed on the tag, makes the identification of the elastic yarn wound body far easier when compared to that which is conventional. That is, the information conventionally used in identification is a product indicator label that is applied to the product case that is crated around the elastic yarn wound body package, or a product indicator sticker that is applied to the inside of the paper tube that is a portion of the elastic yarn wound body package, making it difficult to discriminate from another package from the outside, but when the tag is attached there is no need to look into the inside of the paper tube after removal from the crate. While conventionally there have been cases wherein the elastic yarn manufacturers have, for example, varied the colors of the paper tubes to enable the type of elastic yarn to be identified easily, attaching a tag, as described above, reduces the work in changing the colors of the paper tubes, simplifies paper tube procurement, and the like.

Along with the information that is displayed on the tag being information that is read directly by a human, such as text, numbers, symbols, or the like, a barcode wherein it has been converted to digital information that is condensed into information in a one-dimensional pattern, or a two-dimensional code, such as a "QR code" (registered trademark), wherein it is converted into information of a two-dimensional pattern, may be provided as well. When such digital information is used, preferably information regarding traceability, such as the date and location, and the like, of manufacturing of the elastic yarn wound body package, is also included. Moreover, the registered trademark, logo, or the like, of the elastic yarn wound body package may be displayed. The tag information, described above, enables the user that uses the elastic yarn wound body package to use this information to correctly identify the elastic yarn wound body package, and also facilitates requesting improvements, from the elastic yarn manufacturer side, regarding defects, such as broken yarn during processing.

While there is no particular limitation on the elastic yarn that is used with the present invention, polyurethane elastic fibers or polyurethane elastic yarns can be listed as preferred examples. Moreover, the elastic yarn is a multifilament that is structured from a plurality of individual filaments, and normally is an elastic yarn of between 20 filaments and 120 filaments. While, for the gauge of the elastic yarn there is no particular limitation, application to elastic yarn of a dtex of between 150 and 1300 decitex, known as medium/large dtex products, is preferred. The cross section of the filament may be elliptical, peanut-shaped, eyebrow-shaped, or the like, or may be a combined unit wherein these shapes are compounded.

The present invention is also a paper tube comprising, in the vicinity of at least one end, a tail thread wrapping groove having parallel edges along a circumferential direction perpendicular to the axis of the paper tube, the paper tube comprising a recession, the maximum width of which is greater than the width of the tail thread wrapping groove and the deepest part of which is deeper than the tail thread wrapping groove, over the tail thread wrapping groove or an extension of the tail thread wrapping groove.

The paper tube to which the present invention is directed is preferably used for elastic thread. While there is no particular limitation upon the elastic thread, the invention is preferably applied to thread that is longitudinally unreeled along the core direction, with effects being especially noticeable when used in a machining apparatus that longitudinally unreels elastic thread of medium to large linear mass density (150-1,300 decitex) along the core direction. Examples of such elastic thread include polyurethane elastic fibers and polyurethane elastic thread. The elastic thread is a multifilament composed of multiple filaments, ordinarily having 20 to 120 filaments.

As shown in FIG. 7, the paper tube according to the present invention comprises, in the vicinity of at least one end (paper tube end surface 14), a tail thread wrapping groove 13 having parallel edges along a circumferential direction orthogonal to the axis of the paper tube. The edges of the tail thread wrapping groove 13 referred to here are the two facing boundaries between the tail thread wrapping groove and the surface of the paper tube, and are the parts labeled 18 facing each other across the groove in FIG. 8, which shows the tail thread wrapping groove in cross-section. "Parallel" refers to these edges being parallel along at least 80% of the overall length of the tail thread wrapping groove. Here, "parallel" has a runout tolerance of about ±1°. The presence of this tail thread wrapping groove allows for the elimination of cases in which, when forming a reel on the paper tube, a tail thread can be fixed in place, and the tail thread can be hidden or partially caught in the innermost layer of the reel when forming the reel, as in the case of the example of a conventional elastic thread reel package schematically illustrated in FIG. 5. The "vicinity" of an end of the paper tube refers to an area closer to an axial end of the paper tube than at least the width over which the elastic thread is wound, i.e., the exposed part of the end of the paper tube in the reel package; the presence of the tail thread wrapping groove in this part allows the first part of the thread that is wound onto the tube when forming the reel to be extracted as a tail thread. Generally, assuming a paper tube length of 100%, the vicinity of the ends is preferably 5-10% from the ends. The exposed parts of the ends of a paper tube in a typical reel package having an elastic thread net weight of 4.5 kg are 8-15 mm apiece. The effects of the present invention can be manifested as long as a tail thread wrapping groove is present in the vicinity of at least one end, but it is preferably that grooves be present at both ends, as this allows the orientation of the paper tube to be disregarded when forming the reel, and the orientation of the paper tube need only be reversed when one groove loses its grip, making it harder to form a tail thread, after repeated use. If a tail thread wrapping groove is present near only one end, there is no problem in disposing the reel so that the exposed length of the end on which the groove is present is greater than the other end.

The tail thread wrapping groove extends in a circumferential direction orthogonal to the axis of the paper tube, either along the entire circumference (as in 7*a*-1 and 7*b*-2 in FIG. 7) or discontinuously along the circumferential direction (as in 7*b*-1 and 7*b*-2 in FIG. 7). If the tail thread wrapping groove is not present along the entire circumference, assuming a total paper tube circumference of 100%, the proportion of the length along which the tail thread wrapping groove is not present is preferably 3-10%, more preferably about 4-8%, as this allows the tail thread to be reliably gripped in the tail thread wrapping groove when wrapping the thread.

There is no particular limitation upon the method used to form the tail thread wrapping groove in the vicinity of the end of the paper tube, such as forming a continuous recession via compression, or using a blade to cut a groove, but cutting out a groove by pressing a rotary blade against the tube is preferable. Among the reasons for this is that the shape of the groove can be altered by altering the shape of the rotary blade, the depth and width of the groove can be freely altered via the manner in which the blade is pressed against the tube, and a groove of complex shape can be formed by using a combination of rotary blades of different shapes. Because the groove is imparted via machining in this way, the cross-sectional shape of the groove is typically a letter-V shape, a substantially letter-V shape, or an analogous shape.

The formation of the tail thread, i.e., the efficient surface during wrapping, the linear mass density and modulus of the elastic thread, etc., may be taken into account in determining the groove-directional shape of the tail thread wrapping groove. For example, the groove may have an intake groove formed by making part of the tail thread wrapping groove wider than the rest so as to facilitate wrapping the tail thread in the groove, or such parts at multiple locations along the circumferential direction of the groove. The depth of the intake groove is the same as the depth of the other parts of the tail thread wrapping groove (as defined hereafter).

There is no particular limitation upon the length of the tail thread of the elastic thread reel package, and said length may be set via a mechanism such as a wrapper for wrapping the elastic thread; ordinarily, the tail thread is wrapped at least two times, more preferably at least three times, still more preferably at least five times, around the tail thread wrapping groove in the paper tube. There is no particular limitation upon the maximum number of times the thread is wrapped around the tail thread wrapping groove in the paper tube, but 10 times will often be sufficient.

The width of the tail thread wrapping groove in the present invention indicates the length thereof in the axial direction of the paper tube that can easily be determined by superficially measuring the part of the surface of the paper tube that is recessed inward in the through-thickness direction of the paper tube towards the center of the paper tube. Specifically, it is the length between the edges 18 of the tail thread wrapping groove labeled W in the schematic cross-sectional view of the groove in FIG. 8. If the groove width is not constant along the circumferential direction—for example, if there is an intake groove part that is wider than the other parts of the groove—the average width of the groove is used.

As shown in FIG. 8, the depth of the tail thread wrapping groove of the present invention is the position on a 50 μm circle A that is farthest from a position corresponding to the outside 15 of the paper tube when the circle A is disposed in the cross section of the groove as close to the bottom of the groove as possible. In other words, the depth is defined as D2 in FIG. 8, rather than D1.

The recession of the present invention is a recessed section having a maximum width that is greater than the width of the tail thread wrapping groove and a maximum depth that is greater than the depth of the tail thread wrapping groove, and is disposed over the tail thread wrapping groove in the paper tube, or over an extension of the tail thread wrapping groove. The depth of the recession is defined in a similar manner as the depth of the tail thread wrapping groove, and the maximum depth thereof is the position in the recession having the maximum depth as thus defined. The presence of the recession over the tail thread wrapping groove or an extension of the tail thread wrapping groove allows the recession to be disposed beneath the tail thread wrapped at the position of the tail thread wrapping groove in the reel package, allowing, for example, the tail thread wrapping groove to be snagged with a jig with an L-shaped hook and easily drawn out in the direction of the end. Over the tail thread wrapping groove or an extension of the tail thread wrapping groove means the deepest part of the tail thread wrapping groove or an extension of the deepest part of the tail thread wrapping groove.

The shape of the recession as seen from the surface of the paper tube may be polygonal, rectangular, roughly triangular, circular, elliptical, or any other shape. Preferably, at least one side of the recession, or the diameter thereof if circular in shape, intersects the deepest part of the tail thread wrapping groove at least as seen from the surface of the paper tube. It is especially preferable that the length along the surface of the paper tube in the circumferential direction in which the tail thread wrapping groove overlaps the recession be 1-10 mm, more preferably 2-5 mm. This is because such a range allows the tail thread to be more easily snagged and drawn out in the direction of the end using a jig with an L-shaped hook or the like.

The recession preferably has a groove shape such that at least the length thereof is greater than the width of the tail thread wrapping groove, and intersects the circumferential direction perpendicular to the axis of the paper tube. Imparting the recession with such a shape causes the groove-shaped recession to intersect the tail thread wrapping groove or an extension of the tail thread wrapping groove. This allows the tail thread to be even more easily snagged and drawn in the direction of the end. Regarding the manner in which the groove-shaped recession intersects, it is sufficient for at least part of the recession to overlap the deepest position in the tail thread wrapping groove or an extension of the deepest position in the tail thread wrapping groove as described above; it is preferable that the depth of the recession at the deepest position in the tail thread wrapping groove or an extension of the deepest position in the tail thread wrapping groove be greater than the depth of the tail thread wrapping groove, more preferably overlapping the entire width of the tail thread wrapping groove. If the recession overlaps the entire width of the tail thread wrapping groove, the recession preferably does not extend underneath the reel, and may be designed according to the shape of the target reel package. Specifically, the position of the end of the recession nearer the reel is preferably 1-10 mm from the tail thread wrapping groove toward the center of the paper tube.

If the recession has a groove shape such that at least the length thereof is greater than the width of the tail thread wrapping groove, and intersects the circumferential direction perpendicular to the axis of the paper tube, the groove-shaped recession intersecting the circumferential direction orthogonal to the axis of the paper tube preferably extends to the end of the paper tube. This allows the tail thread to be even more easily snagged and drawn out in the direction of the end using a jig with an L-shaped hook or the like.

At least part of the recession may penetrate the paper tube. In such cases, the position at which the recession penetrates the tube is preferably a position overlapping the tail thread wrapping groove or an extension of the tail thread wrapping groove. This is because having the recession penetrate the paper tube at such a position allows the tail thread to be pushed up from within the paper tube (16 in FIG. 8) and extracted.

For similar reasons, if the recession has a groove shape such that at least the length thereof is greater than the width of the tail thread wrapping groove, and intersects the circumferential direction perpendicular to the axis of the paper tube, the recession preferably penetrates the tube over the entire width (W in FIG. 8) of the tail thread wrapping groove. In an embodiment in which the groove reaches the end of the paper tube, having the recession penetrate the tube over the entire length includes embodiments in which a notch runs from the end of the paper tube.

Wrapping elastic thread around the paper tube having the tail thread wrapping groove and recession described above to form an elastic thread reel package yields a reel package in which the tail thread is anchored in the tail thread wrapping groove, and can easily be extracted.

While the present invention will be explained in greater detail below using embodiments and examples, the present invention is not limited to these forms.

Embodiments of Elastic Yarn Wound Body Package

A polyurethane elastic yarn wound body package was produced with a yarn net weight of 4.5 kg by winding, into a tail yarn winding groove, 19 winds of 620 decitex polyurethane elastic yarn, made from 56 unit filaments with an elastic yarn average diameter of 0.33 mm, onto an elastic yarn paper tube 7 that had a paper tube with length of 175 mm, a diameter of 82 mm, a surface circumference of 257 mm, and a wall thickness of 4 mm, with a moisture proof cellophane film made from regenerated cellulose wound onto the surface thereof, with a tail yarn winding groove 8 cut in a range of 95% of the circumference of the paper tube, with a groove width of 4 mm. At this time, the length of the exposed portion of the paper tube on the side wherein the groove existed in the elastic yarn wound body package was 10 mm.

Embodiment 1

One "Loop Lock" (registered trademark), made from nylon, with a total length of 130 mm and a straight part that was 0.8 mm thick, was used to form a loop through a portion of a yarn bundle formed in the tail yarn winding groove, and, specifically, passing so as to cross 10 winds, in the elastic yarn wound body package described above, to produce an elastic yarn wound body package (FIG. 2-2).

Embodiment 2

One "Insulock" (registered trademark), made from nylon, with a total length of 100 mm, a width of the tape-shaped portion of 2.6 mm, and a thickness of 0.8 mm, was used to form a loop passing a portion of the yarn bundle formed on the tail yarn winding groove, and, specifically, so as to cross eight winds, to produce an elastic yarn wound body package (FIG. 2-3).

Embodiment 3

In the elastic yarn wound body package set forth above, one "Looplock" (registered trademark), made from nylon, with a total length of 265 mm, and a thickness of the wire-shaped portion of 0.8 mm, was used to form a loop passing a portion of the yarn bundle formed on the tail yarn winding groove, and, specifically, so as to cross 10 winds, to produce an elastic yarn wound body package (FIG. 4).

Reference Example 1

19 winds of a 620 decitex polyurethane elastic yarn with an elastic yarn average diameter of 0.33 mm, with 56 individual filaments, were wound onto the paper tube 1 in the tail yarn winding groove, to produce a polyurethane elastic yarn wound body package with a yarn net weight of 4.5 kg (FIG. 2-1).

Reference Example 2

The same tape-shaped object as in Embodiment 2 was used on the paper tube 1 to form a loop crossing a part, wherein no groove was cut, of a yarn bundle of eight winds formed over a tail yarn winding groove, where the tail yarn was bundled at that part, to produce an elastic yarn wound body package (FIG. 2-4).

For the respective polyurethane elastic yarn winding bodies of Reference Examples 1 and 2 and Embodiments 1 through 3, the results of comparing the ease of retrieving tail yarns through operations wherein the tail yarns were grasped by hand are shown in Table 1. At this time, upon evaluation wherein the evaluation was "0" if retrieval was easy, "A" if retrieval was somewhat worse, and "X" if retrieval was difficult, the tail yarn was retrieved more easily in Embodiments 1 through 3 than in Reference Example 1 and Reference Example 2.

Figure 1C:
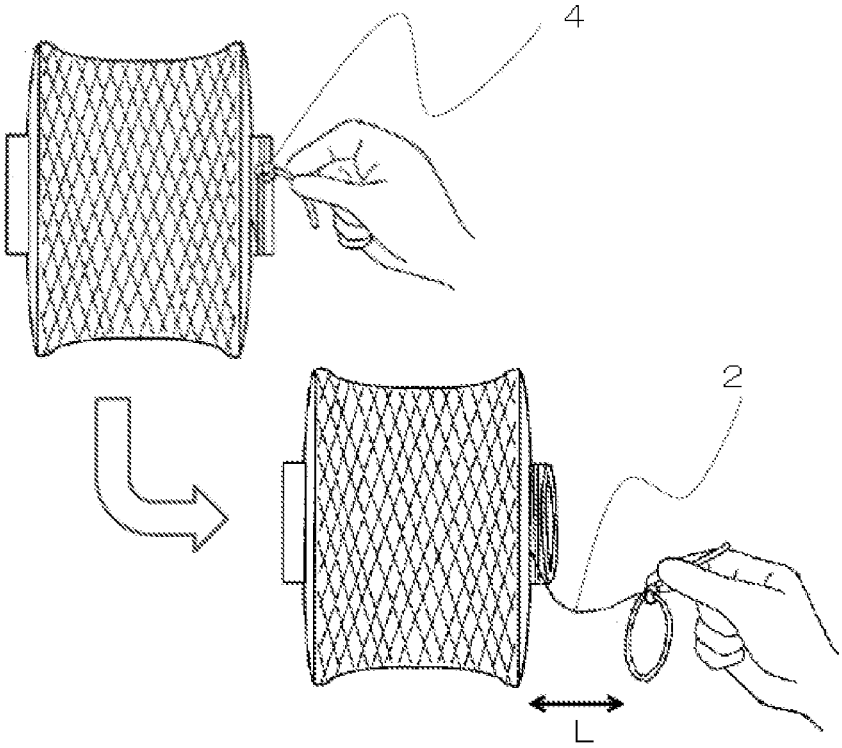
FIG. 1C is a schematic diagram depicting the state wherein the tail yarn used in a reference example is pulled out.

The results of retrieving the tail yarns by grasping the tape-shaped objects by hand, as in FIG. 1C and FIG. 1B, and measuring the lengths of the tail yarns obtained (L in FIG. 1C and FIG. 1B), for Reference Example 2 and Embodiment 2, are given in Table 2. It was clear that there is variability in the length of the tail yarn when the yarn bundle is completely tightened, which would have a negative impact on handling in the processing plant, where the loose bundle produced superior results.

TABLE 1

| | Embodiment 1 | Embodiment 2 | Embodiment 3 | Reference Example 1 | Reference Example 2 |
|---|---|---|---|---|---|
| Evaluation of ease of | ○ | Δ | ○ | X | X |

TABLE 1-continued

| | Embodiment 1 | Embodiment 2 | Embodiment 3 | Reference Example 1 | Reference Example 2 |
|---|---|---|---|---|---|
| operation when grasping with fingers and pulling out | | | | | |

TABLE 2

| Test No. | 1 | 2 | 3 | 4 | 5 | Evaluation |
|---|---|---|---|---|---|---|
| Embodiment 2 (L in FIG. 1B) | 60 cm or more | 60 cm or more | 60 cm or more | 60 cm or more | 60 cm or more | ○ |
| Reference Example 2 (L in FIG. 1C) | 11 cm | 26 cm | 22 cm | 44 cm | 28 cm | X |

Examples of Paper Tubes

Paper tube 1: A tail thread groove having a groove width W of 4 mm and a groove depth D1 of 2.5 mm is cut around the entire circumference of an elastic thread paper tube having a width of 175 mm, a diameter of 82 mm, a surface circumferential length of 257 mm, and a thickness of 4 mm wrapped with moisture-proof cellophane film made of regenerated cellulose (paper tube 1 in FIG. 9).

Paper tube 2: A tail thread groove having a groove width W of 4 mm and a groove depth D1 of 2.5 mm is cut around 95% of the entire circumference of an elastic thread paper tube having a width of 175 mm, a diameter of 82 mm, a surface circumferential length of 257 mm, and a thickness of 4 mm wrapped with moisture-proof cellophane film made of regenerated cellulose (paper tube 2 in FIG. 9).

Example 1

A recession having a maximum length of 8 mm, a depth of 3 mm, and a width of 3 mm in the tail thread wrapping direction was provided orthogonally to a position over the tail thread groove at one location on the paper tube 1 as shown in FIG. 9 so that a side of the recession extended to the end of the paper tube, thereby yielding a paper tube 1-1. 620 decitex polyurethane elastic thread having a filament count of 56 and an average elastic thread diameter of 0.33 mm was wrapped 19 times around the tail thread groove in paper tube 1-1 to yield a polyurethane elastic thread package having a thread net weight of 4.5 kg. The length of the exposed end of the reel package in which the groove is present was 10 mm.

Example 2

A cutout groove having a maximum side length of 8 mm and a width of 3 mm in the tail thread wrapping direction was provided orthogonally to a position over the tail thread groove at one location on the paper tube 1 as shown in FIG. 9, thereby yielding a paper tube 1-2, and a polyurethane elastic thread package was obtained as in example 1, except that this paper tube was used.

Example 3

A through-hole having a recession diameter of 6 mm was provided at one location over the tail thread groove in the paper tube 1 as shown in FIG. 9, thereby yielding a paper tube 1-3, and a polyurethane elastic thread package was obtained as in example 1, except that this paper tube was used.

Example 4

A recession having a maximum length of 8 mm, a depth of 3 mm, and a width of 3 mm in the tail thread wrapping direction was provided at one location orthogonal to an extension of the tail thread groove in a section constituted by 5% of the total circumference of the paper tube 2 in which the tail thread groove was not present so that one side of the recession extended to the end of the paper tube as shown in FIG. 9 to obtain a paper tube 2-1, and a polyurethane elastic thread package was obtained as in example 1, except that this paper tube was used.

Example 5

A cutout groove having a maximum side length of 8 mm and a width of 3 mm in the tail thread wrapping direction was provided at one location orthogonal to an extension of the tail thread groove in a section constituted by 5% of the total circumference of the paper tube 2 in which the tail thread groove was not present as shown in FIG. 9 to obtain a paper tube 2-2, and a polyurethane elastic thread package was obtained as in example 1, except that this paper tube was used.

Example 6

A through-hole having a recession diameter of 6 mm was provided at one location orthogonal to an extension of the tail thread groove in a section constituted by 5% of the total circumference of the paper tube 2 in which the tail thread groove was not present as shown in FIG. 9 to obtain a paper tube 1-3, and a polyurethane elastic thread package was obtained as in example 1, except that this paper tube was used.

Table 3 shows the results of a comparison of the ease with which the tail thread could be extracted, either by manually pinching the tail thread or by drawing out the tail thread using a jig having an L-shaped hook obtained by bending a 100 mm-long, 0.5 mm-diameter wire, from the polyurethane elastic thread packages of the comparative example and examples 1-6. ○ indicates that the thread could easily be extracted, Δ indicates that the thread could be extracted with slight difficulty, and x indicates that the thread could not be extracted without difficulty. The thread could be extracted in examples 1-6 more easily than in the comparative example.

Comparative Example 1

620 decitex polyurethane elastic thread having a filament count of 56 and an average elastic thread diameter of 0.33 mm was wrapped 19 times around the tail thread groove in paper tube 1 to yield a polyurethane elastic thread package having a thread net weight of 4.5 kg.

TABLE 3

| | COMPARATIVE EXAMPLE | EXAMPLE 1 | EXAMPLE 2 | EXAMPLE 3 | EXAMPLE 4 | EXAMPLE 5 | EXAMPLE 6 |
|---|---|---|---|---|---|---|---|
| PINCH WITH FINGERS | X | ○ | ○ | Δ | ○ | ○ | ○ |
| DRAW OUT WITH L-SHAPED JIG | X | ○ | ○ | ○ | ○ | ○ | ○ |

EXPLANATIONS OF REFERENCE SYMBOLS

1: Wire-shaped object
2: Tail yarn
3: Tape-shaped object
4: Tape-shaped object wherein the tail yarn is completely tightly bundled
5: Yarn bundle of tail yarn that is wound into a tail yarn winding groove of a paper tube
6: Wire-shaped object of a loop length that is longer than the circumference of the paper tube
7: Paper tube
8: Tail yarn winding groove
9: Elastic yarn wound body
10: Lead yarn
11: Tag attached to a wire-shaped object
12: Perforation for tearing
13: Tail thread wrapping groove
14: Paper tube end surface
15: Outside of paper tube
16: Inside of paper tube
17: Axial direction of paper tube
18: Edge of tail thread wrapping groove
A: Tail yarn winding direction
L: Length of tail yarn that is pulled out
D1: Groove depth
W: Groove width

The invention claimed is:

1. An elastic yarn wound body package comprising a paper tube and an elastic yarn wound body, wherein:

the paper tube has a groove in the circumferential direction, perpendicular to the paper tube axis, between an end portion of the elastic yarn wound body and an end portion of the paper tube;

a tail yarn of the elastic yarn wound body is wound into the groove; and a wire-shaped object or tape-shaped object that crosses at least a portion of the yarn bundle of the tail yarn is held thereby, wherein the wire-shaped object or tape-shaped object is ring-shaped; and the yarn bundle of the tail yarn is a loose bundle.

2. An elastic yarn wound body package as set forth in claim 1, wherein:

a loop length of the wire-shaped object or tape-shaped object that has formed a ring shape is longer than a circumference of the paper tube, and is set in a state wherein the paper tube is disposed within the loop.

3. An elastic yarn wound body package as set forth in claim 1, wherein:

the material of the wire-shaped object or tape-shaped object is flexible.

4. An elastic yarn wound body package as set forth in claim 1, wherein:

at least one tag is attached by the wire-shaped object or tape-shaped object.

* * * * *